US005875607A

United States Patent [19]

Vohra

[11] Patent Number: 5,875,607

[45] Date of Patent: Mar. 2, 1999

[54] LOW-COST EXTERIOR INSULATION PROCESS AND STRUCTURE

[75] Inventor: Arun Vohra, Bethesda, Md.

[73] Assignee: The United States of America as represented by the United States Department of Energy, Washington, D.C.

[21] Appl. No.: 897,009

[22] Filed: Jul. 18, 1997

Related U.S. Application Data

[60] Provisional application No. 60/025,067 Aug. 28, 1996.

[51] Int. Cl.[6] ..... E04B 1/00

[52] U.S. Cl. ..... 52/741.41; 52/405.1

[58] Field of Search ..... 52/380, 381, 382, 52/383, 405.1, 405.2, 741.14, 741.41, 745.03, 745.05, 745.09, DIG. 14, 407.1, 407.5

[56] References Cited

U.S. PATENT DOCUMENTS

| | | | |
|---|---|---|---|
| 3,933,182 | 1/1976 | Costes | 138/149 |
| 3,979,870 | 9/1976 | Moore | 52/577 |
| 4,158,275 | 6/1979 | Moore | 52/210 |
| 4,191,001 | 3/1980 | L'Heureux | 52/241.41 X |
| 4,203,456 | 5/1980 | Miller | 131/230 |
| 4,231,884 | 11/1980 | Dorius | 252/62 |
| 4,259,824 | 4/1981 | Lopez | 52/612 |
| 4,372,092 | 2/1983 | Lopez | 52/612 |
| 4,373,955 | 2/1983 | Bouchard et al. | 106/98 |
| 4,803,107 | 2/1989 | Knowles | 428/68 |
| 5,017,232 | 5/1991 | Miceli | 106/711 |
| 5,228,914 | 7/1993 | Miceli | 106/694 |
| 5,292,366 | 3/1994 | Miceli | 106/708 |
| 5,398,472 | 3/1995 | Eichelkraut | 52/380 X |

FOREIGN PATENT DOCUMENTS

| | | | |
|---|---|---|---|
| 2469519 | 5/1981 | France | 52/380 |
| 2484500 | 12/1981 | France | 52/405.1 |
| 2493376 | 5/1982 | France | 52/407.1 |
| 95/00722 | 7/1995 | WIPO | 52/405.1 |

*Primary Examiner*—Creighton Smith

*Attorney, Agent, or Firm*—William R. Moser; Paul A. Gottlieb

[57] ABSTRACT

A low-cost exterior insulation process of stacking bags of insulating material against a wall and covering them with wire mesh and stucco provides a durable structure with good insulating value.

20 Claims, 1 Drawing Sheet

LOW-COST EXTERIOR INSULATION PROCESS AND STRUCTURE

This application claims benefit of provisional application Ser. No. 60/025,067 filed Aug. 28, 1996.

BACKGROUND OF THE INVENTION

The invention relates to insulation for exterior walls, in particular, low-cost insulation using readily available materials which can be assembled on-site. Much of the prior art pertains to factory made articles which are not assembled on-site from readily available materials.

Materials such as pumice have high insulation values and are locally available in some areas such as the southwest United States. Use of such materials to insulate exterior walls provides a means for low income individuals to insulate their houses at minimal cost. Stacking bags of the insulation material against the exterior wall enables the insulating structure to conform to uneven wall and ground surfaces. Insulation members such as those described in U.S. Pat. No. 3,979,870 utilize low cost insulation materials but are not readily assembled on-site and are rigid and thus do not comform to uneven surfaces.

SUMMARY OF THE INVENTION

The invention relates to a low-cost process for insulating walls comprising:

(a) stacking bags filled with insulating material next to the exterior surface of a wall until the wall is covered, the stack of bags thus formed having fasteners to attach to a wire mesh (e.g., straps looped between the bags and fastened to the wall)

(b) stretching a wire mesh (e.g., chicken wire or stucco netting) over the stack of bags, covering the side of the bags which is not adjacent to the wall, (c) fastening the wire mesh to stationary objects, (d) attaching the wire mesh to said fasteners on said stack of bags, and (e) applying a cemetitious material (e.g., stucco) to the wire mesh and allowing it to harden.

Stacking the bags against the wall is preferably preceded by laying a base on the ground at the foot of the wall using a material such a cement or crushed stone wrapped in a non-woven fabric (e.g., geosynthetic felt). It is also preferred to erect stationary corner posts at the ends of the wall to be insulated, the top ends of the posts being tied to each other and/or tied or otherwised anchored to the wall.

The invention also includes the structure made by this process. The structure comprises a stack of bags of insulating material next to the exterior wall of a building, said stack of bags of insulating material being attached to said wall and having a covering of cementitious material on the side not adjacent to said wall.

DETAILED DESCRIPTION OF THE INVENTION

The most preferred embodiment of the process of the invention for insulating walls comprises:

(1) erecting corner posts at the ends of the wall to be insulated, the top ends of the posts being tied to each other and/tied or otherwise anchored to the wall, (2) laying a base on the ground at the foot of the wall for the insulation, (3) stacking bags filled with insulating material on the base until the wall is covered, said bags having fasteners to attach to a wire mesh, (4) stretching a wire mesh over the bags between the corner posts, (5) fastening the wire mesh to said posts, (6) attaching the mesh to said fasteners, and (7) applying a cementitious material to the wire mesh and allowing it to harden.

Figure 1A:
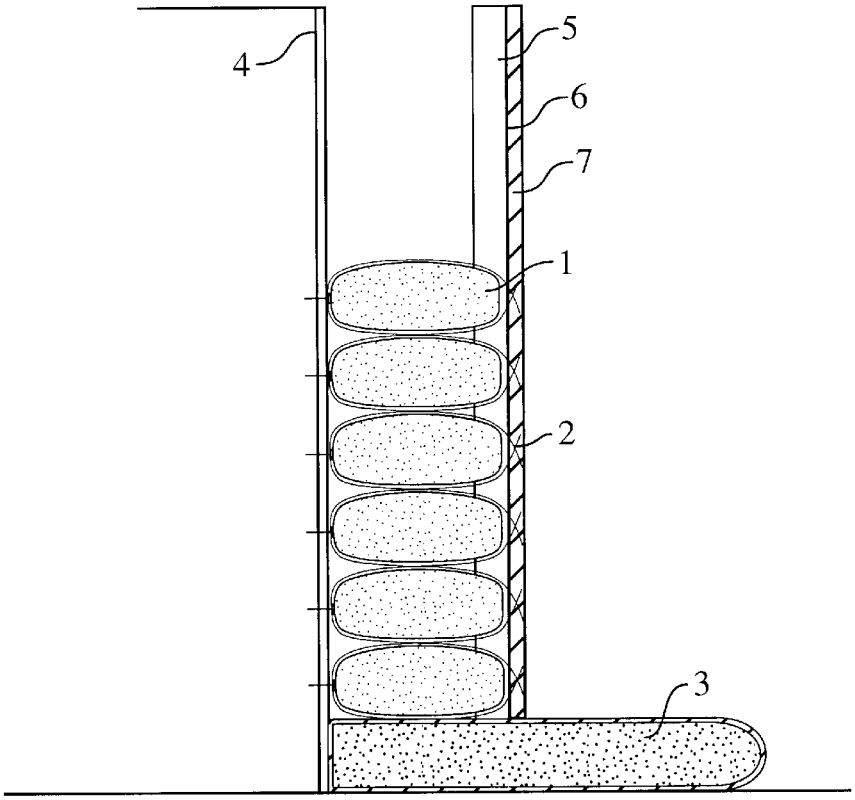
FIG. 1A is side view of the bags of insulating material next to the exterior wall of a building before application of cementitious material.
Figure 1B:
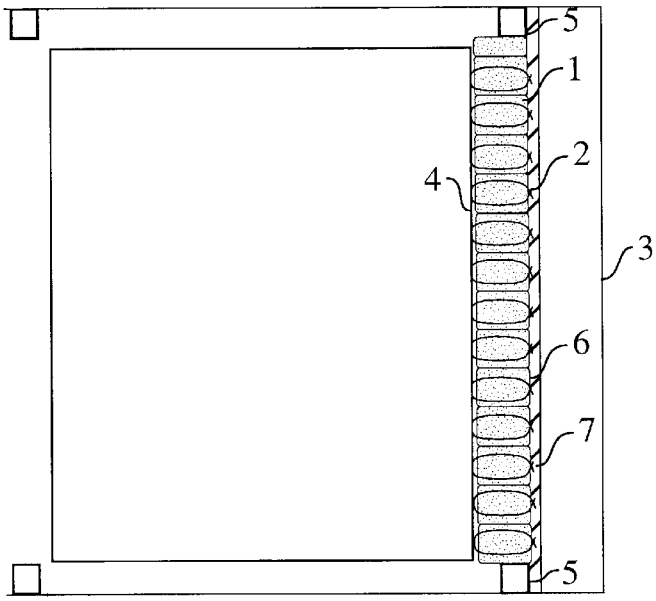
FIG. 1B is a top view showing the bags with straps looped around them and corner posts at the ends of the wall.

Referring to the drawings, FIG. 1A is a side view of the bags (1) of insulating material stacked on the base (3) next to the wall (4) of an existing house with straps (2) looped around the bags. The corner posts (5) at the ends of the wall are preferably set in the ground. Wire mesh will then be fasted to the corner posts and the straps will be fasted to the wire mesh. The cementitious material will then be applied to the wire mesh. FIG. 1B is a top view showing the bags stacked up along the length of wall (4) between corner posts (5).

The corner posts erected at the ends of the wall are stationary objects to which the wire mesh can be fastened. They also help to form square corners on the insulation at the ends of the wall. If corner posts are not used, the wire mesh can be fastened to the wall (the wall ends being stationary objects). In either case, the length of the insulating structure is self-supporting with the bags supporting the wire mesh and stucco skin. The use of supporting studs can thereby be avoided.

It is also preferred to lay a base of cement or crushed rock wrapped in a non-woven fabric to minimize water erosion under the bags of insulating material.

The bags of insulating material may have straps looped between them and fastened to the wall. These straps are also used to attach to the wire mesh. Other types of fasteners for fastening the wire mesh to the bags and, preferably, also fastening the bags to the wall, may be used as well. Equivalents of the bags of insulating material may be used also, such as a fabric tube or the like as a means of containing the insulating material.

In addition to pumice, the insulating material may be fiberglass, rock wool, milled pulverized paper, wood pulp, expanded clays and shales, perlite, flyash, agricultural waste materials such as straw, leaves, shredded leaves, sawdust, peat moss, vermiculite, or other material having a reasonable insulation value.

The process of the invention has proven useful in insulating existing adobe walls. It may be used with other types of walls also. In a test of the invention, a wall of an adobe house was insulated by stacking bags of pumice against it according to the method of the invention. The bags were covered with wire mesh and a glass fiber reinforced Portland cement stucco shell. This structure has not shown significant cracking or deterioration.

The process of the invention yields an insulated structure comprising a stack of bags of insulating material next to the exterior wall of a building, said stack of bags of insulating material being attached to said wall and having a covering of cementitious material on the side not adjacent to said wall. By "next to the exterior wall" is meant in close proximity to the wall, i.e., touching it or not more than a fraction of an inch therefrom. The closed ends of the bags are lined up vertically on the sides of window and door openings. A lintel is placed on top of the bags at the level of the top of the window or door. Wire mesh is fastened, and stucco is applied. No extra framing is needed. This system uses a minimal amount of lumber and conserves trees and forests.

The wire mesh is preferably anchored to the ground by weaving rebars (e.g., one-half inch) through the bottom 12 inches of the wire mesh and driving them into the ground. The rebars can be 3 feet long and spaced every 2 feet or so. A firm stucco shell is obtained by achoring the wire mesh in this manner.

What is claimed is:

1. A low-cost process for insulating walls comprising:

(a) stacking bags filled with insulating material next to the exterior surface of a wall until the wall is covered, the stack of bags thus formed having fasteners to attach to a wire mesh, (b) stretching a wire mesh over the stack of bags, covering the side of the bags which is not adjacent to the wall, (c) fastening the wire mesh to stationary objects, (d) attaching the wire mesh to said fasteners on said stack of bags, and (e) applying a cemetitious material to the wire mesh and allowing it to harden.

2. The process of claim 1 wherein said fasteners for attaching the wire mesh to the stack of bags are straps looped between the bags and fastened to the wall.

3. The process of claim 1 wherein said wire mesh is chicken wire or stucco netting.

4. The process of claim 1 having the additional step, prior to stacking the bags, of laying a base on the ground on which the bags will be stacked, said base comprising cement or crushed stone wrapped in a non-woven fabric.

5. The process of claim 1 having the additional step of erecting corner posts at the ends of the wall to be insulated, wherein said stationary objects are said corner posts.

6. The process of claim 5 wherein said posts are tied or otherwise anchored to the wall.

7. The process of claim 1 wherein said cementitious material is stucco, and the top ends of said posts are tied together.

8. A low-cost process for insulating walls comprising:

(a) erecting corner posts at the ends of the wall to be insulated, the top ends of the posts being tied or otherwise anchored to the wall, (b) laying a base on the ground at the foot of the wall for the insulation, (c) stacking bags filled with insulating material on the base until the wall is covered, said bags having fasteners to attach to a wire mesh, (d) stretching a wire mesh over the bags between the corner posts, (e) fastening the wire mesh to said posts, (f) attaching the mesh to said fasteners, and (g) applying a cementitious material to the wire mesh and allowing it to harden.

9. A process according to claim 8 wherein said base is comprised of cement or crushed stone wrapped in non-woven fabric.

10. A process according to claim 8 wherein said insulating material is pumice.

11. A process according to claim 8 wherein said cementitious material is stucco.

12. The process of claim 8 wherein said fasteners for attaching the wire mesh to the stack of bags are straps looped between the bags and fastened to the wall.

13. An insulated structure comprising a stack of bags of insulating material next to the exterior wall of a building, said stack of bags of insulating material being attached to said wall by straps looped between said bags and attached to said wall, said stack of bags having a covering of wire mesh and cementitious material on the side not adjacent to said wall.

14. An insulated structure comprising a stack of bags of insulating material next to the exterior wall of a building, said stack of bags of insulating material supporting a skin of wire mesh and cementitious material on the side of the bags which is not adjacent to the wall.

15. An insulated structure of claim 14 wherein said wire mesh is attached to corner posts at the ends of the wall.

16. An insulated structure of claim 15 wherein said cementitious material is stucco.

17. An insulated structure of claim 16 wherein said insulating material is pumice.

18. An insulated structure of claim 17 wherein the wire mesh is attached to the stack of bags by straps looped around the bags.

19. An insulated structure of claim 18 wherein said straps are also attached to the wall.

20. An insulated structure of claim 19 wherein the wall is adobe.

* * * * *